United States Patent [19]

Holmes

[11] Patent Number: 4,949,887

[45] Date of Patent: Aug. 21, 1990

[54] INSULATED MULTI-USE SEAT CUSHION WITH CLOSABLE HAND AND FOOT OPENINGS

[76] Inventor: William A. Holmes, 209 Highland Ave., Piedmont, Calif. 94611-3709

[21] Appl. No.: 132,982

[22] Filed: Dec. 15, 1987

Related U.S. Application Data

[63] Continuation-in-part of Ser. No. 867,453, May 28, 1986, abandoned.

[51] Int. Cl.[5] ..... A61G 1/00

[52] U.S. Cl. ..... 224/151; 224/205; 224/236; 2/66; 2/202; 126/204; 297/188

[58] Field of Search ..... 224/151, 153, 202, 205, 224/257, 206, 207, 236, 237; 2/66, 91, 93, 108, 202, 203; 383/61, 110, 98, 99, 8; 128/382; 190/107, 102; 5/417–421; 297/230, 188, 192, 219; 126/204, 207, 208

[56] References Cited

U.S. PATENT DOCUMENTS

| | | | |
|---|---|---|---|
| 273,523 | 3/1883 | Havasy | 190/102 |
| 1,137,049 | 4/1915 | Bushwick | 190/107 |
| 2,835,896 | 5/1958 | Giese | 2/66 |
| 3,460,740 | 8/1969 | Hagen | 383/110 |
| 3,793,643 | 2/1974 | Kinoshita | 2/66 |
| 4,423,834 | 1/1984 | Rush | 224/151 |
| 4,604,987 | 8/1986 | Keltner | 5/421 |

*Primary Examiner*—Linda J. Sholl
*Attorney, Agent, or Firm*—David Pressman

[57] ABSTRACT

An insulated hollow cushion has a neck strap (30), an interior portion (72) sufficiently large to accommodate a portable heating source and/or hot and cold foods (74, 76), two side slits through which hands can be inserted for warmth, sealable flaps (16, 20) for closing the side slits when insulation is desired, a slit (36) at the top of the cushion for insertion of items into the cushion's interior, a closeable top flap (28) to seal the top opening for insulation purposes, and a closeable top small flap (56) to insulate the gap between a user's ankles when such user's feet are inserted through the top slit. The side flaps can be insulated so that they can be tucked into the side openings to narrow these openings to provide a tight seal when small hands are inserted into these openings. The insulating layer within the front (10) or the back panel can have multiple perforations (92) over an area thereof and this area can be covered, uncovered, or partially covered by a releasably closable flap (84), thereby to provide a "heat window" which allows maximum transmission of heat (or cold) from an internal hot (or cold) source, or partial transmission, or no more transmission than would occur through an intact insulated wall.

20 Claims, 6 Drawing Sheets

INSULATED MULTI-USE SEAT CUSHION WITH CLOSABLE HAND AND FOOT OPENINGS

BACKGROUND—CROSS-REFERENCE TO RELATED APPLICATION

This is a continuation-in-part of application Ser. No. 867,453, filed May 28, 1986, now abandoned.

BACKGROUND—FIELD OF INVENTION

This invention relates to a portable insulating device, specifically to a hollow cushion made of insulating material, with multiple insulating and storage uses, including insulation of body parts.

BACKGROUND—DESCRIPTION OF PRIOR ART

In outdoor sports and cultural events, spectators often sit for hours at a time in uncomfortably cold temperatures. Heretofore, articles of clothing, blankets, and sleeping bags have been designed to provide such spectators with protection from the cold for various parts of their anatomy. Some of these devices are heavy and are worn as articles of clothing. Thus U.S. Pat. No. 2,659,086 (McGrath 1953) shows an overcoat with hand slots, a hood, and devices for fastening around the wearer's legs when in a sitting position. This device is unduly bulky, costly, and awkward to use and carry. Further, it lacks versatility.

Another device is not only bulky but involves a complex series of zippers and folding configurations. Thus, U.S. Pat. No. 2,442,105 (Vacheron 1948) shows a multipurpose blanket with zippers along each edge which, when the blanket is folded properly, can have a variety of uses, such as a cover for the front or back of a sitting person, a baby blanket, a strapless container, and a sleeping bag. Again, the device is awkward to use and carry, expensive, and, as stated, bu1ky.

Some devices were designed primarily to warm a spectator's legs and lower torso. Thus U.S. Pat. No. 3,798,676 (Shanks et al. 1974) shows a garment that can be fastened about the legs by means of a zipper and attached to the torso with a drawstring. It contains a bult-in sitting cushion, protective slots for warming the wearer's hands, and a detachable hood for protection of the head. U.S. Pat. No. 3,597,764 (Povey 1971) shows a zippered foot and leg warmer which attaches to the torso with a buckled strap and which also has a built-in pad to protect the wearer's buttocks from the cold. And U.S. Pat. No. 4,363,141 (Doster 1982) is a quilt for the lower extremities to be used by people in wheelchairs. These devices are also awkward, bulky, and expensive.

Finally, a series of devices show simpler means for protecting the wearer from the elements. Thus, U.S. Pat. No. 1,971,469 (Wallin 1934) shows a sleeping bag which can be converted to a blanket when the user is sitting in the open (such as riding in an open car). U.S. Pat. No. 4,534,065 (Comfort 1985) shows a blanket, with a pouch for insertng a heating pad or bag, which can be folded into a wrap for a sitter's lower extremities. U.S. Pat. No. 4,178,637 (Wrightson 1979) shows a body robe which can be fastened about the lower extremities. Finally, U.S. Pat. No. 906,51 (Newman 1908) shows a child's garment comprising a large sheet with fold-over sides and a top flap with a head opening. These devices are no less bulky than the previously described devices and have many of their other drawbacks.

In sum, all previous attempts to provide a means for keeping spectators warm at outdoor events utilized bulky garments or blanketlike devices; their sole function was to insulate one or more portions of the human anatomy.

OBJECTS AND ADVANTAGES:

Unlike the prior art, the cushion of my invention uses an insulated interior space and variable means of access to this space to provide outside-event spectators with an insulated space that can be used to warm, alternatively, their hands, feet, or buttocks. Additionally, my cushion can be used as an insulated container for hot or cold food and drinks.

My invention recognizes that people attending outdoor events often have to walk a long distance from the parking area to the area where the activity occurs. The lightweight and unitary design of my invention thus allows the spectator to carry the cushion easily to an event and to warm parts of his or her anatomy as needed while observing the event; as such it has obvious advantages over devices that are bulky and heavy.

Other objects and advantages of my invention are to provide an insulating device which is versatile, compact, light, inexpensive, and easy to use. Readers will find further objects and advantages of the invention from a consideration of the ensuing description and the accompanying drawings.

DRAWING FIGURES

DRAWING REFERENCE NUMERALS

Figure 1:
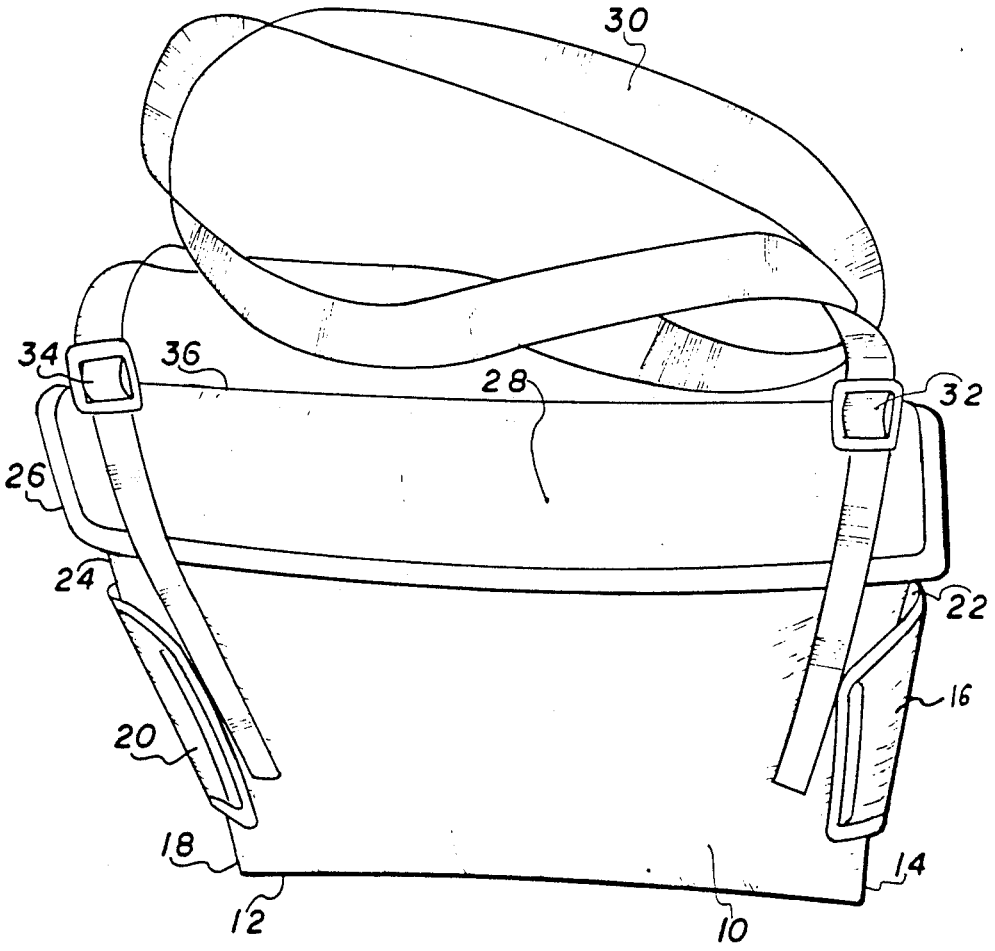
FIG. 1 is a perspective top view of the outside portion of a multi-use insulated cushion of my invention, with side and top flaps closed.

10 front panel
12 bottom edge
14 lower right seam
16 right flap
18 lower left seam
20 left flap
22 upper right seam
24 upper left seam
26 back panel
28 top flap
30 neck strap
32 right neck strap connection 34 left neck strap connection
36 top edge of pouch
38 inside surface of right flap
40 H & L fastener on right flap (loop)
42 H & L fastener on right front panel (hook)
44 inside surface of left flap
46 H & L fastener on left flap (loop)
48 H & L fastener on left front panel of cushion (hook)
50 inside surface of large top flap
52 H & L fastener on inside surface of large top flap (loop)
54 H & L fastener on front surface of cushion (hook)
56 small top flap
58 seam joining small top flap to back panel
60 H & L fastener on inside surface of small top flap
62 user's left hand
64 user's right hand
66 lap of user
68 left foot of user
70 right foot of user
72 interior of cushion
74 dry food items
76 wet food items and ice
84 internal flap
86 H & L fastener
88 H & L fastener
90 heat window
92 hole
94 cutaway area

DESCRIPTION—FIG. 1—CUSHION CLOSED

FIG. 1 shows the outside of the multi-use insulated cushion of my invention. It consists of the following component parts:

A rectangular front panel 10 is made of 400 denier woven nylon (coated for water repellency) and measures 16.25" across (from its lower and upper right seams 14, 22, to its lower and upper left seams 18, 24), and 12" high (from its bottom edge 12 to its top edge 36).

A plain rectangular back panel 26 (not shown) continues over the top to form a front and top flap 28. Front flap 28 is 2.25" high, and can be securely fastened to front panel 10. Back panel 26 has the same width as front panel 10 and is an integral continuation of panel 10, the two panels being joined by a bottom fold 12.

Lower and upper right seams 14 and 22 (each 3.25" long) join front panel 10 to back panel 26. Lower and upper left seams 18 and 24 (each 3.25" long) also join front panel 10 to back panel 26.

Sealable right and left flaps 16 and 20 are integral extensions of back panel 26 and each has a trapezoidal shape. Each flap's base (where it joins back panel 26) is 7" long, its height (horizontal dimension in FIG. 1) is 2", and the width of its free end (vertical dimension in FIG. 1) is 5" long.

An adjustable nylon neck strap 30 is joined to the top of the cushion by conventional right and left connectors or buckles 32 and 34. Connectors 32 and 34 are each joined to the top of back panel 26 by short (1") sections of strap (not shown).

Front and back panels 10 and 26, side flaps 16 and 20, small top flap 56, and inner insulated flap 84 preferably are all cut from one piece of nylon. They are lined with a thinner or lighter inner nylon layer 72 (FIG. 5A) of 200 denier weight. The outer and inner layers sandwich an insulating layer, preferably of synthetic polyester, such as that sold under the trademark THINSULATE CS200 of Minneapolis Mining and Manufacturing Co. of Minneapolis, Minn.

Front and back panels 10 and 26, as well as top flap 28 and small top flap 56, are all insulated in order to increase the "R" (resistance to heat flow) value of the walls of these components, i.e., in order to reduce the flow of heat directly through the walls of these components.

Side flaps 16 and 20 do not have to be insulated to prevent heat loss since there is no more heat lost per inch of border through the side flaps than through the portions above and below the side openings. However these side flaps are insulated, but for an altogether different purpose: to provide adjustability in the closeness of fit for various users' hands in the side openings. If a more snug fit is required in this area, e.g., for one with small hands, the flaps can be tucked into the slits before inserting the hands. If larger-sized openings are required to accomodate larger hands and wrists, then the flaps may be left on the outside to provide additional room. This ability to adjust the closeness of this fit to different hand sizes is extremely desirable in this device because a loose fit (over a small hand) would allow too much heat to leak out during use and a fit that is too tight (over a large hand) would not allow insertion of the hands without great difficulty. Preferably the side slots are made large enough to comfortably but snugly accommodate an adult male's hand and the insulating flaps are insulated sufficiently so that, when tucked into the slots, they will reduce the area of the slot so that the maximum circumference of a hand that can be accommodated is at least ⅜" less than with the slot per se.

It is more difficult to manufacture this device with an insulated flap because extra insultating material is required and because of the extra thickness of the bag at this point. These factors make it more difficult to sew, requiring special equipment to join this thickened section. However I prefer to have these flaps insulated for the important reasons outlined above, and also because insulating these flaps helps solve the difficult problem of mass-producing cushions to fit both men and women well, since the circumference of the closed hand of most men is larger than that of most women.

FIG. 2—CUSHION OPEN

Figure 2:
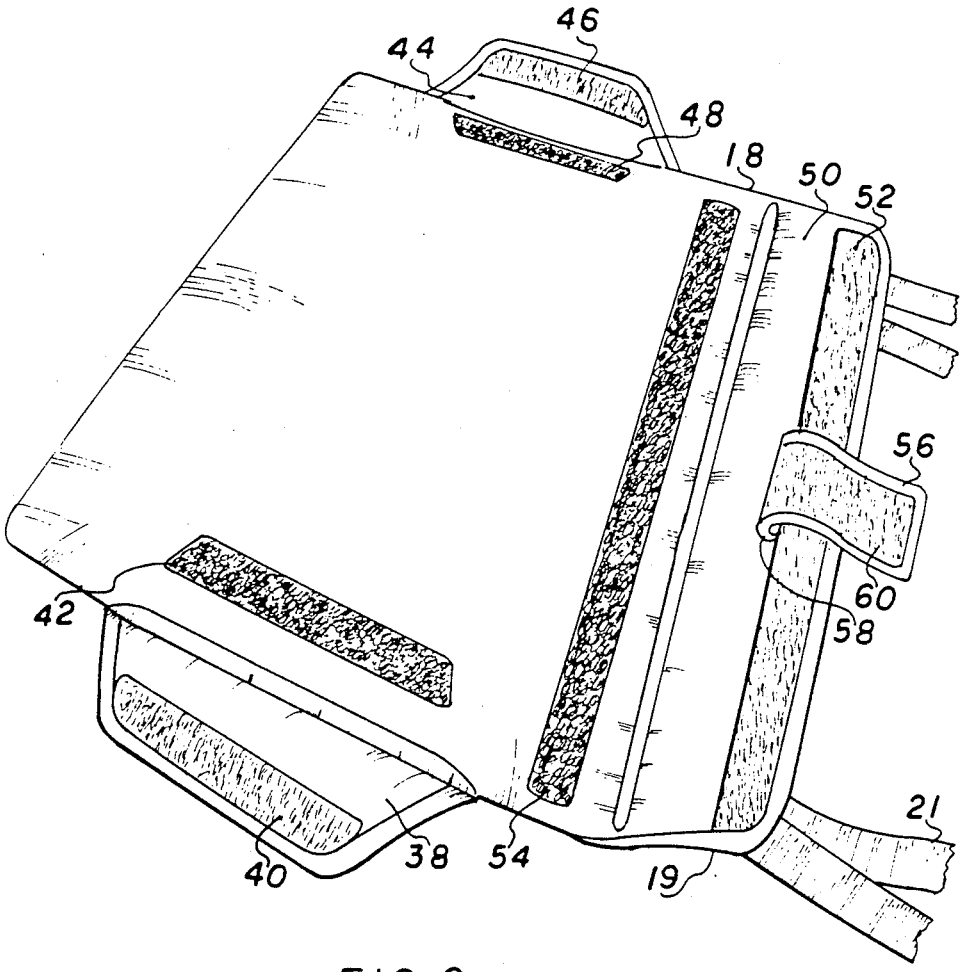
FIG. 2 is a side view of the cushion with the side flaps and top flaps open.

FIG. 2 shows the front of the cushion with all sealable flaps open. Inner side 38 of the right flap 16 contains a rectangular strip of a hook and loop (H & L) fastener 40, sold under the marks Velcro and Latchlok. A mating strip of a H & L fastener 42 is attached to front right panel 10. Similarly, inner surface 44 of left flap 20 has a H & L fastener 46. A mating H & L fastener 48 is attached to the front left side of panel 10. Preferably strips 42, 48, and 54 are the hook portions of the H & L fasteners and the mating halves of the H & L fasteners are strips of loop material which have far less tendency to snag or rub if the user's hands or feet pass thereover.

Inner surface 50 of top flap 28 has a H & L fastener strip 52. Strip 52 runs for the width of the top flap between its right and left edges. A mating strip of H & L fastener 54 is attached to the top of front panel 10. Strip 54 runs along the top of panel 10 from the upper right seam 22 to upper left seam 24. Mating strips 52 and 54 hold top flap 28 securely but releasably to front panel 10.

A small top flap 56 (2.125" wide and 3" long) is attached to inside surface 50 of top flap 28 at the bottom of fastener strip 52. A strip of a H & L fastener 60 is attached to the inside surface of small top flap 56. Flap 56 can be independently attached to strip 54 while large top flap 28 is open. When so attached, flap 56 provides a divider to divide the top opening of the cushion into two smaller openings, as explained below.

Insulated inner flap 84 (7" wide and 4" long) is releasably attached to the inside surface of front panel 10 at its middle. Mating H & L fastening strips 86 and 88 hold inner insulated flap 84 releasably to front panel 10. A rectangular area or "heat window" 90 (2.25" long and 4.75" wide) of the inside surface is surrounded on three sides by the H & L fastener. The insulation inside this area is perforated by rows of holes 92, as shown in cutaway area 94. The inner and outer layers of cloth and perforated insulation are stitched together (stitching not shown) around and throughout the perforated area to prevent shifting of the perforated insulation. The stitching that joins the H & L pile to the inner cloth surface of panel 10 also joins the insulation to this cloth surface, and to the outer cloth surface as well, creating a thermal barrier.

To facilitate manufacture, the insulation in inner insulated flap 84 does not need to be quite as thick as the insulation in the walls of the cushion. It need only be thick enough to overcome, when it is closed, the extra heat lost through the perforated portion of the insulation, so that the "R-value" of the overall wall will be at least as high as if the insulation were not perforated and the flap were not added.

There is considerable leeway in the perforating pattern. While the cushioning properties of the cushion wall are retained better when more holes of smaller size are used, it is important to use a large enough hole size to resist the filling in of the holes during the prolonged compression and twisting that the cushion may be expected to undergo during its lifetime. Cutting out an area of the thicker insulation and stitching in an area of thinner insulation may provide heat-transfer characteristics similar to a perforated area, but this would not cushion quite as well. The pattern shown, i.e., a dozen holes (three rows of four each), each approximately 0.375" in diameter, is a good compromise, although various other patterns and hole sizes can be used.

Inner insulated flap 84 is sewn to the inside surface of panel 10 along one long edge. However, it could be fully detachable, being attached to the panel 10 by only the adhesion between the mating H & L surfaces. I prefer the sewing to be along one edge because it makes the inner insulated flap easier to locate properly for reattachment, it reduces the amount of H & L fastener required, and it prevents the flap from getting lost.

By locating the inner insulated flap in various locations relative to the perforated area, different patterns of heat transfer from the interior of the cushion may be produced. A "heat-window" is thus created. That window may be opened fully to allow maximum transmission of heat or closed fully to restrict the flow to a minimum. Or it may be partially opened to transmit any desired amount in between these two extremes. This window would normally be closed when the device is used as a hand warmer or foot warmer or as an ice container. But when the device is used as a cushion, i.e., either a seat cushion or a cushion for various other parts of the body, or a "heating pad", it may be desirable to open up one or more heat windows of varying shape and in various locations to provide the type of heating pattern desired by the user at that time. Use of a hot water bottle or other heat source, or even a source of cold, such as an ice bag, inside this insulated hollow cushion could give the user a great deal of flexibility for directing that heat or coldness to various parts of the body, while minimizing the undesirable loss of that heat or coldness to the surrounding atmosphere.

It is not necessary to provide inner and outer cloth layers around the insulating layer in this device. The inner or outer cloth layer, or both, could be eliminated and the device would still work as described. However, the sandwiched construction is somewhat preferable because the inner and outer cloth layers serve to retain the perforated insulation and keep contamination out of the interior of the cushion, especially when the window is open.

Figure 3A:
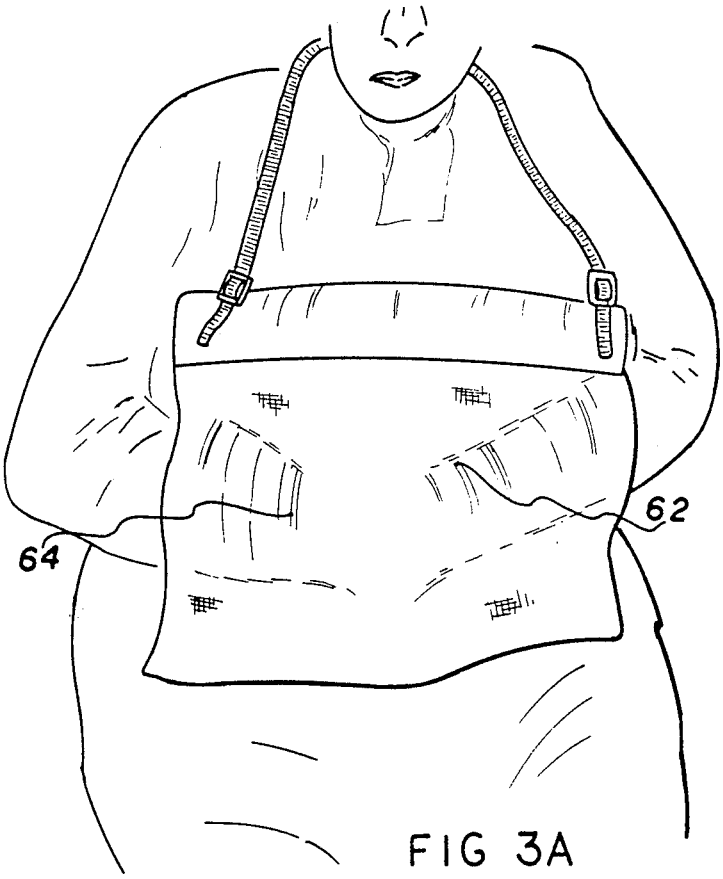
FIG. 3A is a side view of the cushion with the straps used to hang the cushion around the neck of a user and the user's hands inserted into the cushion's interior through slits covered by the side flaps.
Figure 3B:
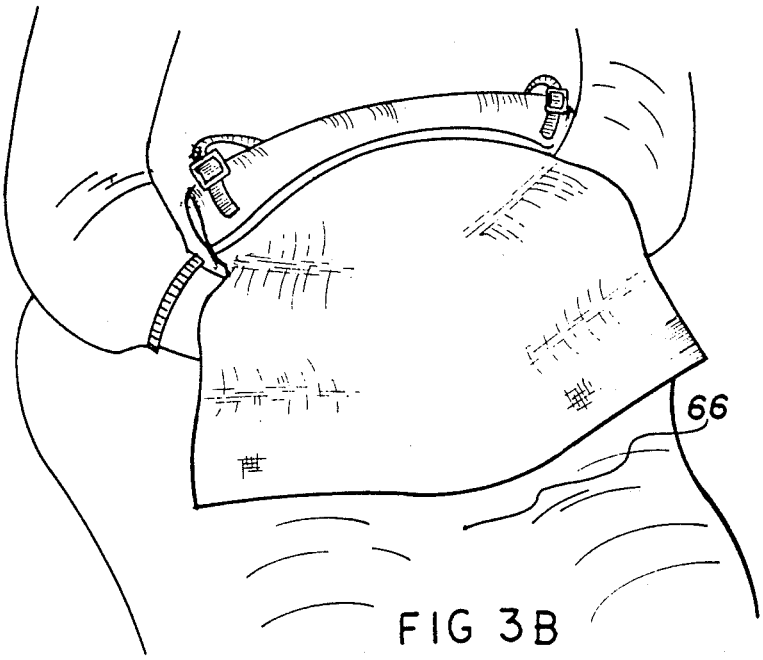
FIG. 3B is a side view of the cushion resting on the lap of the user with the user's hands inserted into the cushion's interior through the open side flaps.

FIGS. 3A and 3B—CUSHION IN USE

FIG. 3A shows the cushion in use as a hand warmer on the lap of a wearer with strap 30 looped around the user's neck. The user's left hand is inserted into the interior of the cushion through the slit in its right side created by opening right flap 16 (not shown in FIG. 3A). The user's right hand is similarly inserted into the left side slit. Top flap 28 is closed to provide maximum insulation for the user's hands. Strap 30, being hung around the user's neck, supports the cushion which in turn supports the user's hands. As stated, if the user has small hands, flaps 16 and 20 can be tucked in to fill the slit so as to provide a good insulating seal, whereas if the user has large hands, these flaps can be left out to provide the full area of the slit to accommodate these hands.

FIG. 3B shows the cushion in use, but without strap 30 around the user's neck. In this position the cushion is free to move around so that the user's hands can be positioned wherever desired while in the cushion.

FIG. 4—CUSHION AS FOOT WARMER

Figure 4:
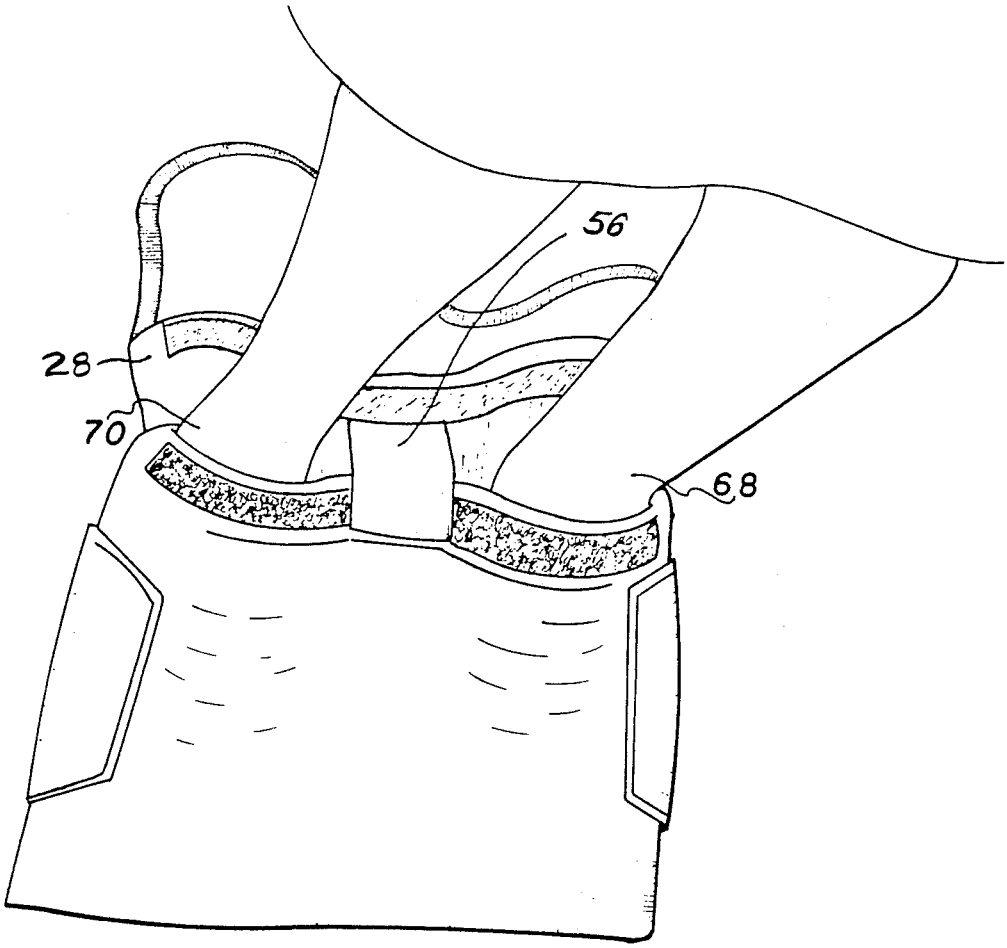
FIG. 4 is a side view showing the cushion on the ground, with the user's feet inserted through the large top flap and the small top flap fastened to preserve the insulating properties of the cushion.

FIG. 4 shows the cushion in use as a foot warmer. For this use, right and left side flaps 16 and 20 are closed and large top flap 28 is open. Small top flap 56 is closed to provide a divider or web which divides the cushion's upper slot into two openings. The user's feet are inserted into these respective openings with the cushion on the ground. The size of the cushion is large enough to accommodate both feet, even with shoes on.

Figure 5A:
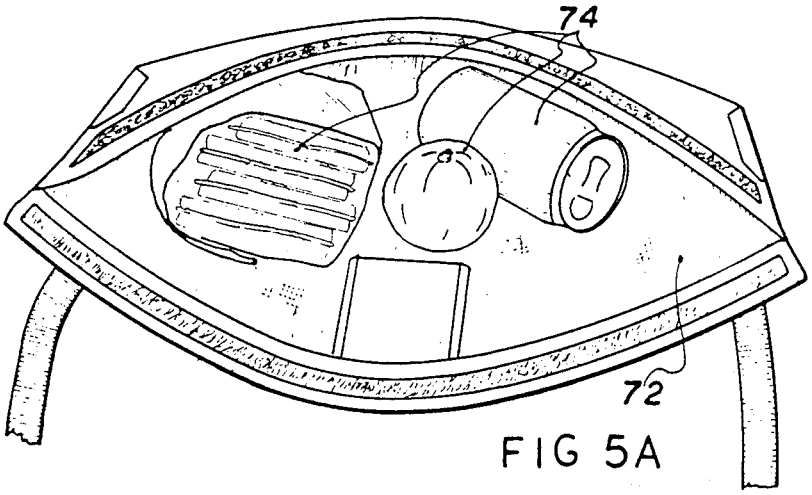
FIG. 5A is a top view showing the cushion holding a portable heat source, or dry food and drink items.
Figure 5B:
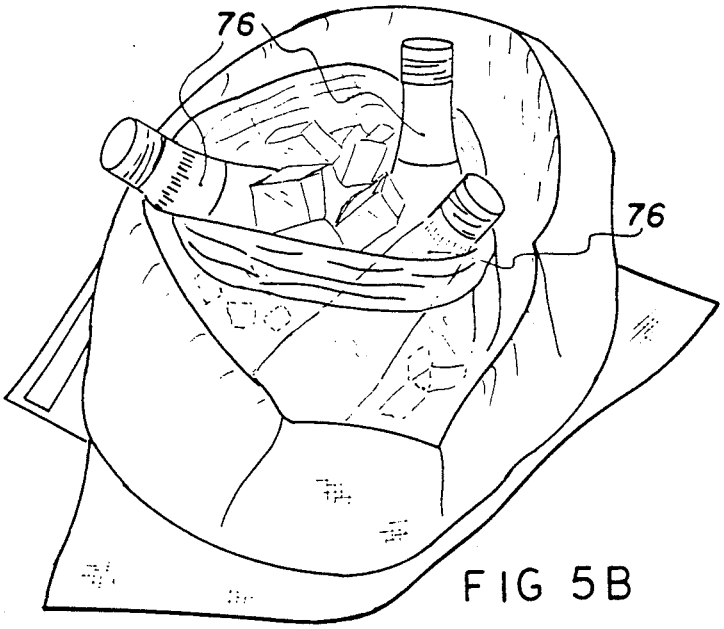
FIG. 5B is a top view showing the cushion holding ice or wet food in a plastic bag.

FIGS. 5A and 5B—CUSHION USED AS ITEM CONTAINER

FIG. 5A shows the cushion's inner lining 72 and several dry cold or hot food items 74 placed directly in the cushion. Side-flaps 16 and 20 are closed and top flap 28 may be closed to insulate the contents.

FIG. 5B shows the cushion holding several wet and cold food items and ice 76. In lieu of ice, dry ice or blue ice can be used. To protect the cushion, the wet or cold food items are placed into a plastic inner bag which is then placed into the cushion. In lieu of ice, a hot pack or other portable heat source may be provided to keep food warm.

OPERATION OF CUSHION

As indicated, the multi-use insulated cushion of my invention can be used in a variety of ways as follows:

A. The empty cushion is hung around the user's neck or placed on the user's lap and is used as a hand or lap warmer (FIGS. 3A and 3B). In this use, the cushion may contain a portable heat source (not shown) to assist the warming function. A most suitable heat source is a super-saturated solution contained in a bag. When heat is needed, e.g., in the middle of a sporting event, the solution is made to recrystalize by mechanical stimulation, whereupon it generates heat.

B. The empty cushion is placed on a ground surface with large top flap 28 open so that the user's feet may be inserted into the cushion's interior (FIG. 4). Small top flap 56 is closed to form a web between the user's ankles to conserve heat.

C. The cushion with all flaps closed can be placed on a seating surface to provide an insulated cushion (not shown). In this usage the cushion can be used empty or can contain a portable heat source.

Figure 7:
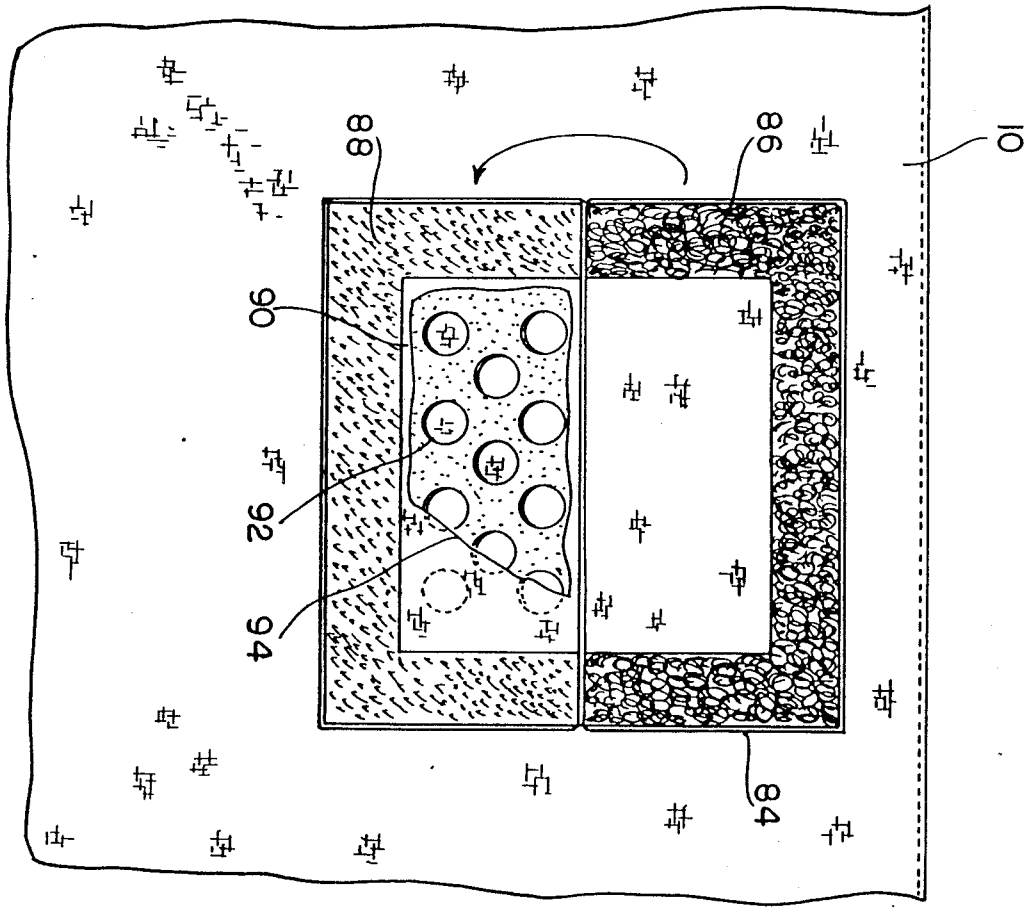
FIG. 7 is an internal, partly cut-away view of a heat-transferring section of a wall of the cushion.

D. The cushion contains a portable heat source, all of its flaps are sealed, and it is utilized as a long-lasting lap, torso, or seat warmer (not shown). If extra heat transfer from the portable heat source is desired, flap 84 (FIG. 7) can be opened, whereupon heat from the source will be able easily to pass through "heat window" 90 created by holes 92.

E. The empty cushion is used with all flaps sealed as an insulated container for dry foods (FIG. 5A).

F. The empty cushion is used with all flaps sealed as an insulated container for wet foods or ice which are contained within their own plastic bag (FIG. 5B).

G. The cushion contains a portable heat source and is used with all flaps sealed as an insulated container for keeping food and drinks warm (not shown).

Figure 6:
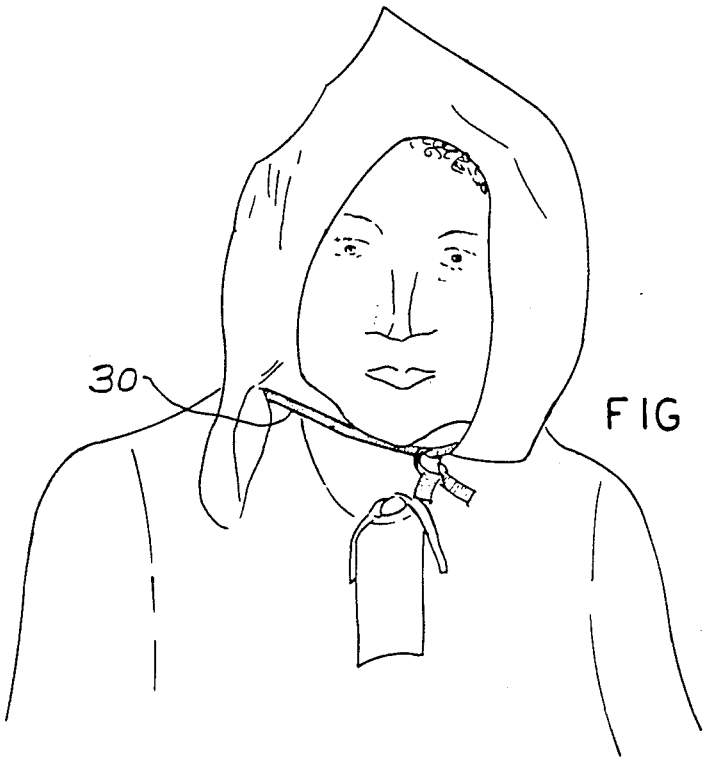
FIG. 6 is a view showing the cushion used as a head warmer.

H. The empty cushion can be used as a head warmer (FIG. 6) by draping it around the head and tying it in place with strap 30.

Note that the cushion can be used for some or all of the above purposes in the same day, e.g., as a food container when going to a football game and as a hand-/foot/buttocks/lap warmer at the game.

CONCLUSION, RAMIFICATIONS, AND SCOPE

Thus it can be seen that the multi-use insulating cushion serves a number of functions commonly desired by people who spend time outdoors as spectators. The side flaps and slits operate to allow easy and intermittent hand warming. With the side flaps closed the top large flap can be opened to permit feet warming, food insulation, and insertion of a portable heat source. When all flaps are closed the cushion operates as a cushion and as an insulator for a portable heat source, food, or drink that is contained within it. The heat can be regulated by opening the internal flap over the heat window and the cushion can accommodate both large and small hands through the expedient of tucking in or pulling out the side flaps.

While the above description contains many specificities, these should not be construed as limitations on the scope of the invention, but rather as an exemplification of one or more preferred embodiments thereof. Other ramifications and embodiments are possible. For instance the cushion can be made of insulating materials other than nylon, e.g., cloth, paper, or plastic; it can have proportionately larger or smaller flaps than those shown; the side flaps can be raised or lowered; the bag can be made of separate pieces (front, back, flaps) which are joined by sewing, adhesive, etc.; its size can be made larger or smaller; its large top flap can be made in two sections with a permanent divider in between; its top and side flaps can be sealed by fasteners other than H & L, such as snaps, hooks, buttons, strings, etc.; it can have a built-in heat source; the cushion can be made of a light, non-insulating material, in which case it would serve as a wind stop; it can have a circular, oval, or triangular shape, etc.

Accordingly, the scope of the invention should be determined not by the embodiments illustrated, but by the appended claims and their legal equivalents.

I claim:

1. An insulating seat cushion which can also provide an insulating container or insulate a human user's hands or feet, comprising, in combination:

front and back panels, each of which has top, bottom and two side edges, each panel having inner and outer opposing major surfaces, said panels being positioned in an overlying, face-to-face relationship such that their inner surfaces face each other, each of said panels being made of insulating material, said panels being permanently joined directly together at their bottom edges and their respective corresponding side edges, including the top of each side edge and along the length of said corresponding side edges, except for a pair of side openings, such that when nothing is positioned between said front and back panels, (a) said inner surfaces of said front and back panels will be in contact with each other, (b) said inner surfaces will lie parallel to each other, and (c) said entire panels, including said outer surfaces thereof, will be parallel to each other, whereby said device with said opposing and parallel outer surfaces can be usable as a cushion, said front and back panels being large enough so that said device can contain the hands or feet of a user, or cover the seat area of such user, each of said side openings being spaced from the top of its side edge and being shorter than its respective side edge, but wide enough to accommodate the passage of a hand therethrough so that said hand can be posititioned between said inner surfaces of said panels, a pair of closure flaps for repeatably closing and opening said respective side openings, each of said closure flaps having one end which is attached to the exterior of one side of said cushion and being arranged so that a user's hand can be inserted into said side opening and remain in said cushion without contacting a closure flap, each of said closure flaps having a height which is less than the height of its respective side edge, the exterior of the other side of said cushion and an opposite end of each closure flap containing means for temporarily attaching said opposite end of each closure flap to the exterior of said other side of said cushion, said cushion having a relatively large top opening which extends substantially across the entire width of the top portion of said cushion from side edge to side edge, and means for repeatably closing the opening said relatively large top opening, whereby said cushion can alternatively be used as a hand warmer by inserting one's hands through said side openings with said top opening closed, a foot warmer by inserting one's feet through said top opening with said side openings closed, as a seat cushion by closing both said top and said side openings, and as an insulated container by placing hot or cold objects therein.

2. The cushion of claim 1 wherein each of said side flaps is substantially as wide as its side opening, is connected to one of said front and back side panels, and can be folded over its respective side opening to close said opening and lie adjacent said other panel, said other panel and each of said flaps having mating sealing means for repeatable attachment and release of said flap to the outside of said other panel.

3. The cushion of claim 2 wherein each of said side flaps is a continuation of said back panel of said cushion.

4. The cushion of claim 1 wherein said means for repeatably closing and opening said relatively large opening comprises a relatively large flap which is an extension of one of said front and back side panels and which can be position over said relatively large opening to close said relatively large opening and lie adjacent the other of said panels, said other panel and said relatively large flap having mating sealing means for attachment of said relatively large flap to the outside of said other panel.

5. The cushion of claim 4 wherein said relatively large opening is at the top of said cushion and said relatively large flap is a top flap, and further including a relatively small top flap inside said relatively large top flap and mounted in the center of said relatively large opening of said cushion, said relatively small flap arranged to connect said front and back panels at said relatively large opening so as to divide said top opening of said cushion into two apertures for the respective feet of a user.

6. The cushion of claim 1 wherein each side of said cushion is permanently sealed for a length of each side below as well as above each side opening.

7. The cushion of claim 1 wherein said pair of closure flaps for repeatably closing and opening said side openings each includes multiple hook and loop fasteners.

8. The cushion of claim 1 wherein said front and back panels are each rectangular in shape and are each made of multiple layers of material, one of said layers being an insulating layer.

9. The cushion of claim 8 wherein said pair of closure flaps for repeatably closing and opening said side openings and said means for repeatably closing and opening said relatively large opening are made of material portions which are integral extensions of said back panel.

10. The hollow cushion of claim 1 wherein each of said closure flaps contains a layer of insulating material so that is sufficiently thick in cross-section so that it will reduce by at least ⅜" the maximum circumference of a hand that can be inserted into its corresponding side opening when said side flap has been inserted into said side opening.

11. The hollow cushion of claim 1 wherein one of said front and back panels has a discrete area, smaller than said panel, which contains multiple perforation for permitting the passage of heat in a controlled fashion between said interior space of said cushion and the outside of said cushion.

12. The insulated hollow cushion of claim 1, further including an auxiliary insulated flap for controlling the passage of heat between said interior space of said cushion and the outside of said cushion, said auxiliary insulated flap having means for repeatably being attached and detached onto the area of said panel which covers said discrete area thereof so as to alternatively restrict or permit the flow of heat through said perforated portion of said panel.

13. The cushion of claim 11 wherein said front and back panels are each rectangular in shape and are each made of multiple layers of material, one of said layers being an insulating layer, said insulating layer including said discrete area which contains said multiple perforations.

14. A hollow cushion for insulating a human user's hands or feet, or for providing an insulating seat cushion, or for providing an insulating container, comprising, in combination:

a front panel of insulating material having a top edge, a bottom edge, a pair of side edges, and opposing inner and outer major surfaces, a back panel of insulating material having a top edge, a bottom edge, a pair of side edges, and opposing inner and outer major surfaces, said back panel being disposed in underlying, parallel relationship with said front panel to define an interior, said front and back panels being permanently joined directly together along their respective bottom edges and along portions of their respective side edges which extend partially down from their respective tope edges toward said respective bottom edges so as to define an opening on each side edge for insertion of the hands of a user within said interior, such that when nothing is placed between said front and back panels, said inner surfaces of said front and back panels will be adjacent, parallel to, and in contact with each other, and said outer surfaces will be parallel to each other, said front and back panels being large enough so that said device can contain the hands or feet of a user, or cover the seat area of such user, a pair of releasable closure flaps on said panels respectively associated with said side openings, said front and back panels defining an upper opening which extends between said side edges for insertion of the feet of a user within said interior, and releasable closure means on said panels associated with said upper opening, whereby said cushion is selectively usable as a hand warmer with said upper opening closed, a foot warmer with said side openings closed, and as a seat cushion with both said upper and said side openings closed.

15. The cushion of claim 14 wherein said front and back panels are also permanently joined together along portions of their respective side edges which extend partially up from said bottom edges to said respective openings on said side edges.

16. An insulating hollow cushion, comprising:

an insulating wall comprising a front panel and a back panel, said front and back panels each having an inside surface and an outside surface, said front and back panels being joined around at least a portion of their edges so that they define and surround an interior hollow space, and such that said inside surfaces face each other and said outside surfaces face away from each other, each of said panels comprising three adjacent layers, namely an outer layer, a middle insulating layer, and an inner layer, said outer and inner layers sandwiching and in contact with the respective sides of said middle insulating layer, said middle insulating layer of one of said panels having a discrete area, smaller than said one panel, which contains multiple perforations to permit the passage of heat, in a controlled fashion via said perforations, between said hollow interior space of said cushion and the outside of said cushion, the portions of said outer and inner layers of said one panel which sandwich said discrete area of said middle insulating layer are intact, continuous, and completely cover the outside and inside, respectively, of said discrete area of said middle insulating layer so as to completely protect said perforations in said discrete area.

17. The insulating hollow cushion of claim 16 wherein said multiple perforations in said discrete area of said insulating middle layer are arranged in a two-dimensional array.

18. The insulating hollow cushion of claim 17 wherein said discrete area is positioned in the middle of said one panel.

19. The insulating hollow cushion of claim 16, further including an auxiliary flap for controlling the passage of heat between said interior space of said cushion and the outside of said cushion, said auxiliary insulating flap having means for repeatably being attached and detached over either a part or all of the area of said discrete area of said insulating layer, such that a user can control the flow of heat through said perforated portion of said insulating layer.

20. The insulating hollow cushion of claim 16 wherein each of said perforations in said discrete area of said insulating layer has less than two square inches of cross-sectional area.

* * * * *

UNITED STATES PATENT AND TRADEMARK OFFICE

CERTIFICATE OF CORRECTION

PATENT NO. : 4,949,887

DATED : 1990 Aug 21

INVENTOR(S) : Holmes, W. A.

It is certified that error appears in the above-identified patent and that said Letters Patent is hereby corrected as shown below:

Col. 1, l. 39, change "bulky" to --bulky--.

Col. 1, l. 60, change "insertng" to --inserting--.

Col. 8, l. 56, change "the" to --and--.

Col. 9, l. 12, change "position" to --positioned--.

Col. 9, l. 45, change "that is" to --that it is--.

Col. 9, l. 52, change "perforation" to --perforations--.

Col. 10, l. 20, change "tope" to --top--.

Signed and Sealed this

Seventh Day of July, 1992

*Attest:*

DOUGLAS B. COMER

*Attesting Officer*

*Acting Commissioner of Patents and Trademarks*